US006667472B2

(12) United States Patent
Janeczko et al.

(10) Patent No.: US 6,667,472 B2
(45) Date of Patent: Dec. 23, 2003

(54) NIGHT VISION DEVICE WITH ANTIREFLECTION COATING ON CATHODE WINDOW

(75) Inventors: Donald J. Janeczko, Fincastle, VA (US); Nils I. Thomas, Roanoke, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 185 days.

(21) Appl. No.: 09/908,572

(22) Filed: Jul. 20, 2001

(65) Prior Publication Data

US 2003/0015648 A1 Jan. 23, 2003

(51) Int. Cl.[7] ..... H01J 40/14
(52) U.S. Cl. ..... 250/214 VT; 313/542
(58) Field of Search ..... 250/214 VT, 207; 313/542, 543, 544, 479, 384; 359/580, 581, 586

(56) References Cited

U.S. PATENT DOCUMENTS 4,475,059 A * 10/1984 Sink ..... 313/534
5,130,527 A * 7/1992 Gramer et al. ..... 250/214 VT
5,146,076 A * 9/1992 Raverdy et al. ..... 250/213 VT
5,301,069 A * 4/1994 Wood et al. ..... 359/580
6,088,165 A * 7/2000 Janeczko et al. ..... 250/214 VT
6,201,641 B1 * 3/2001 Filipovich ..... 359/419
6,288,386 B1 * 9/2001 Bowen et al. ..... 250/214 VT
6,472,087 B1 * 10/2002 Otani et al. ..... 359/580
6,483,231 B1 * 11/2002 Iosue ..... 250/214 VT

* cited by examiner

*Primary Examiner*—Stephone B. Allen
(74) *Attorney, Agent, or Firm*—Edell, Shapiro & Finnar; Martin Abramson

(57) ABSTRACT

An image intensifier tube which obviates problems with stray reflections caused by bright lights utilizes an antireflection coating in the form of an interference filter on the cathode window. An image intensifier—which is protected against laser damage utilizes a laser reflecting coating on the cathode window. The image intensifier is disposed between an optical input element and an optical utilization element. The cathode window is a glass plate having a photocathode on the side away from the optical input element and an antireflection or laser reflecting coating on the side which faces the optical input element.

2 Claims, 2 Drawing Sheets

NIGHT VISION DEVICE WITH ANTIREFLECTION COATING ON CATHODE WINDOW

FIELD OF THE INVENTION

The present invention is directed to a night vision device, and particularly to a night vision device which avoids problems caused by reflection of bright lights which may be in the field of view.

BACKGROUND OF THE INVENTION

Night vision devices are well known electro-optical devices which afford a user enhanced visibility in darkness. They find widespread application in the military, law enforcement, and security operations.

A night vision device typically includes an objective lens assembly, an image intensifier tube and an eyepiece or ocular. In operation, the objective lens assembly focuses low levels of light including infrared (IR) onto the image intensifier tube, which amplifies the light and transmits it to the eyepiece for viewing of an image. The image intensifier is typically comprised of a cathode for converting light including IR to electrons, a microchannel plate for multiplying the electrons, and a phosphor screen.

A problem occurs when bright light is either in or near the field of view. Such light may bounce back and forth between the image tube and objective lenses creating "ghost" like patterns. The stray light patterns are superimposed upon the image, obscuring the image and degrading the performance of the device.

SUMMARY OF THE INVENTION

It is therefore an object of the present invention to reduce stray light and "ghost" like patterns caused by bright lights in or near the field of view of a night vision device.

In accordance with a first aspect of the invention, the above object is accomplished by providing an image intensifier tube having a cathode window which bears an antireflection coating.

In accordance with a second aspect of the invention, the antireflection coating is disposed on a glass plate which is adhered to the cathode window.

In accordance with a further aspect of the invention, the antireflection coating may be employed directly on the cathode window.

In accordance with a still further aspect of the invention, a laser reflecting coating may be employed on the cathode window in addition to or instead of the antireflection coating, either disposed on a plate or on the cathode window itself.

DETAILED DESCRIPTION OF PREFERRED EMBODIMENTS

Figure 1:
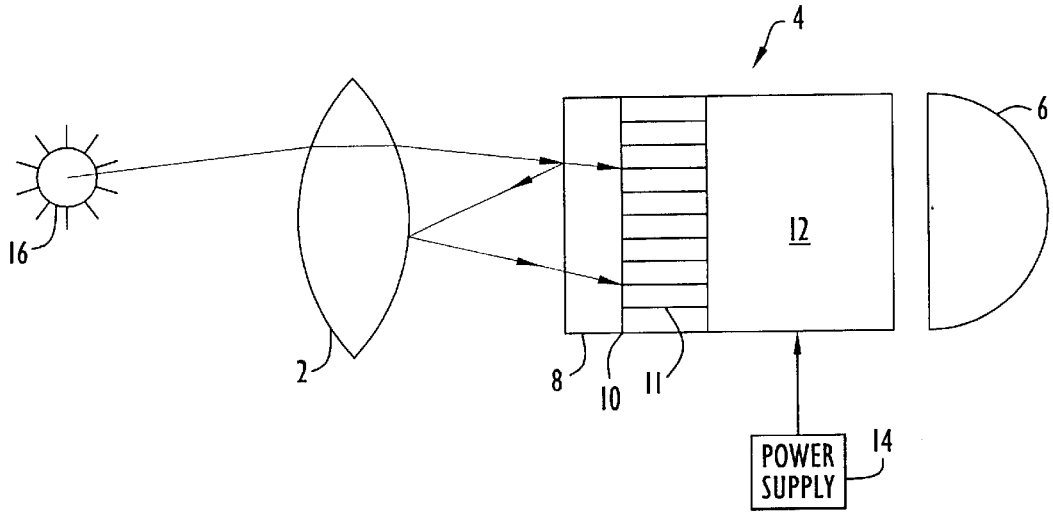
FIG.1 PRIOR ART
FIG. 1 shows an example of the prior art.

Referring to FIG. 1, a prior art night vision device is depicted. The device is comprised of at least one optical input element 2, image intensifier tube 4, and at least one optical utilization element 6. The optical input elements typically comprise an objective lens assembly, but may be a mirror or other imaging device. The optical utilization element 6 is most typically an eyepiece for allowing viewing by a person, but may include different or other elements including for example a photodetector array or film in the case of a video or photographic camera. Referring to FIG. 1, the objective lens means 2 focuses light including IR on the image intensifier tube 4, which amplifies the light and feeds it to eyepiece 6.

The image intensifier 4 includes a cathode window 8, which typically is a glass plate having a photocathode coating 10 disposed on its interior surface. This is typically followed by microchannel plate 11 which is a glass assembly of hollow pores having electron conduction and amplification properties. The microchannel plate is followed by a phosphor screen 12, which is typically a fiber optic coated on its input end with a phosphor coating. A power supply 14 is also provided, which is activated by a battery, and comprises a D.C. to D.C. converter which provides various voltage levels for application to the cathode, microchannel plate and screen.

In the operation of the device, light which includes IR or which may be primarily IR, is focused by objective lens means 2 through glass plate 8 onto photocathode 10. The photocathode, which by way of non-limitative example, may be made of gallium arsenide, converts the light to electrons, which are multiplied in the microchannel plate 11, after which they strike the phosphor of screen 12, which converts them to visible light. The visible light and any image formed thereby may be viewed with the aid of eyepiece 6.

A problem will occur when there are bright lights either in or near the field of view, in that light from such sources may bounce back and forth between the image intensifier and the objective lens means, creating ghost like patterns. These patterns become superimposed on the image, thereby obscuring it and degrading the performance of the device.

The problem is illustrated in FIG. 1, wherein bright light source 16 is in the field of view of the device. After being focused by lens 2, the light is incident on cathode window 8. A small percentage of the light (approximately 4% for glass) is reflected from the exterior surface of the window, with the remainder passing through the window to photocathode 10 where it will result in an image of the light source being formed. The problem is the reflected portion of the light, which as shown in the Figure may again be reflected from the lens and again be incident on the photocathode at a different place than the original ray. It is the incidence on the cathode window of this second ray which creates the ghostlike patterns and which it is desired to avoid.

In accordance with the invention, the problem is solved by providing the cathode window of the image intensifier with an antireflection coating. It should be understood that in an actual embodiment, objective lens means 2 is a lens assembly comprised of many lenses. While theoretically the same result as attained with the invention could be obtained by coating the objective lens assembly with an antireflection coating, to accomplish this every glass surface of each element of the lens assembly would have to be coated, since any uncoated surface could result in reflected energy back to the cathode. Because of the large number of lens elements, and the level of antireflection required, it may be technically impossible, inconvenient or uneconomic to do this, so the invention accomplishes the same result at a significant savings in cost and/or convenience.

Figure 2:
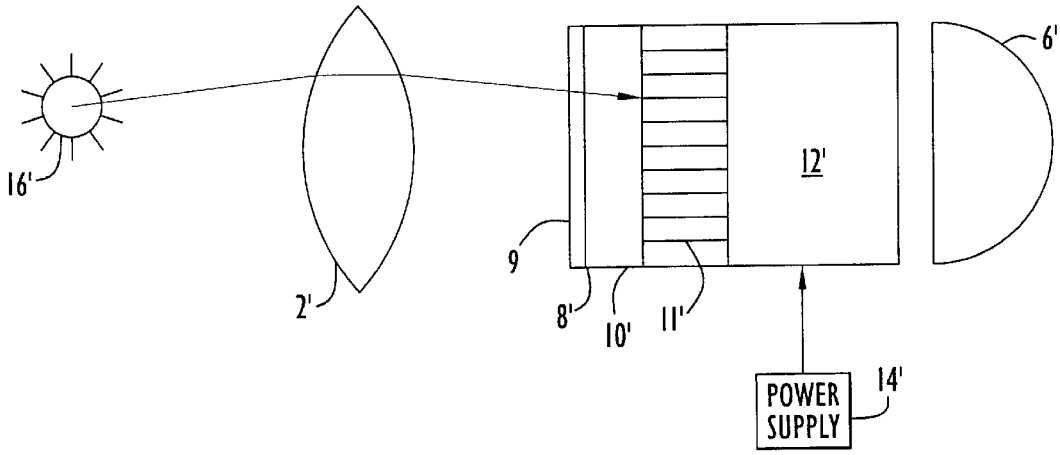
FIG. 2 shows a first embodiment of the present invention.

An embodiment of the invention is depicted in FIG. 2, where for the sake of clarity, components identical to those in FIG. 1 are provided with the same reference numerals in single prime form. It will be seen that cathode window 8' bears an antireflection coating 9', such coating being directly deposited on the exterior surface of the window (coating shown thicker than to scale for purposes of clear illustration). As is well known to those skilled in the art, a typical antireflection coating is comprised of a multiple dielectric layer interference filter, e.g. using layers of materials such as magnesium fluoride, silicon dioxide, zirconium oxide, cesium fluoride, titanium oxide, aluminum oxide and other dielectrics, which layers are arranged so that incoming rays and rays which would be reflected, are 180° out of phase, thus canceling reflected energy. Some improvement can be obtained by using a single layer of magnesium fluoride, but for best results, multiple layers are used. As seen in FIG. 2, the reflected light between the cathode window and the objective is eliminated, and there is no second ray incident on the cathode window to cause a ghostlike pattern.

The antireflection coating may be applied to the cathode window by vacuum evaporation by resistively heated materials with or without ion assist. In the evolution of the aspects of the invention, a first embodiment involved applying the antireflection coating directly to the outside surface of the cathode window, as depicted in FIG. 2. However, this was not without practical disadvantages, as hereinafter explained. The image intensifier manufacturing process tends to warp the cathode window, and a final manufacturing step is the grinding and polishing of the window. Thus, if the coating is applied to the window before manufacturing is completed, it is inclined to be ground off as part of the final step. On the other hand, if the coating is applied after manufacturing is completed, contamination of the tube side walls may result, which may cause electrical short circuit problems. Also, normal vacuum evaporation by resistively heated materials results in temperatures that destroy or degrade the life or the image intensifier tube. To apply the antireflection coating directly to the cathode window requires both total shielding of the sides and rear of the image intensifier tube and the low temperature (below 80° C.) vacuum evaporation by resistively heated materials with ion assist. The ion assist gives the evaporated dielectric material enough energy to stick to the resistively "cold" cathode window. Normal substrate temperatures for coated glass windows are typically higher than 200° C. to 365° C.

Figure 3:
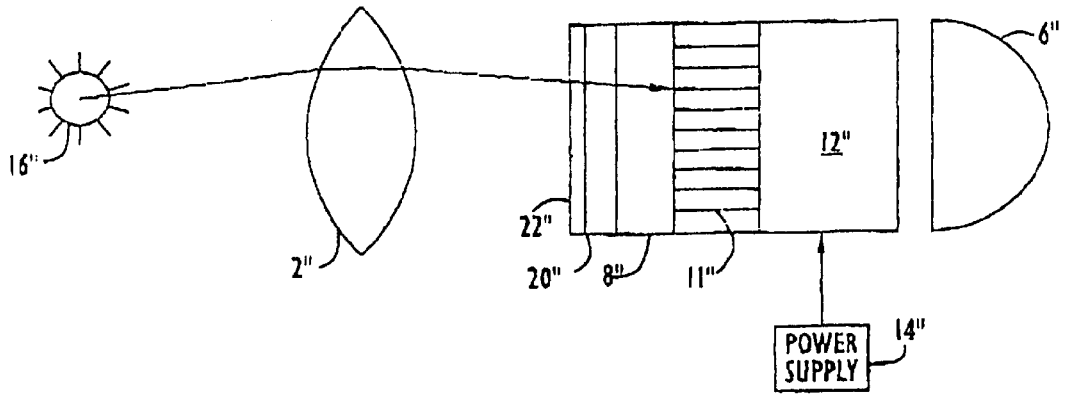
FIG. 3 shows a further embodiment of the invention.

A second embodiment of the invention involves applying an antireflection coating to a transparent plate, and then adhering the transparent plate to the outside surface of the cathode window. Such embodiment avoids the problems discussed above and may be more satisfactory for commercial production. The coating may be applied by vacuum evaporation by resistively heated materials, with or without ion assist. This embodiment is depicted in FIG. 3, wherein identical parts are identified with the same reference numerals as in FIGS. 1 and 2 in double prime form. Referring to FIG. 3, transparent plate 20" on its exterior surface is provided with antireflection coating 22". The interior surface of transparent plate 20" is cemented to the cathode window 8" with transparent cement. As in the embodiment of FIG. 2, the multiple reflection problem is solved.

The transparent plate may be made of optical glass, optical crystal, or optical plastic. For example, Schott BK7 or borosilicate glass are two of the numerous optical glasses which could be used, zinc sulfide, zinc selinide are examples of optical crystals which can be used, and optical plastics include cyclic olefin copolymers, polycarbonate, polystyrene, or polymethyl-methacralate.

In accordance with a further embodiment of the invention, in addition to or instead of an antireflection coating, the cathode window bears a laser reflecting coating. Thus, an adversary attempting to defeat night vision equipment may use a laser as a weapon to attempt to burn a hole in the photocathode and/or microchannel plate. In accordance with the embodiment depicted in FIG. 4, the exterior surface of glass plate 40''' has a laser reflecting coating 42''' deposited thereon, while the interior surface of glass plate 40''' is adhered to cathode window 8'''. The term "laser reflecting coating" as used herein means a coating of a material having a broad enough reflection band to substantially reflect laser light of such wavelengths expected to be encountered. By way of non-limiting example, the laser reflecting coating may be made of dielectric materials such as magnesium fluoride, silicon oxide, zirconium oxide, cesium fluoride, titanium oxide, aluminum oxide, and other dielectrics. The laser reflecting coating can be deposited by itself or can be deposited over or under the antireflection coating, or on the back of the transparent plate. The process for depositing the laser reflecting coating is vacuum evaporation by either resistively heated materials with or without ion assist. It also would be possible to apply the laser reflecting coating directly to the cathode window, as in the embodiment of FIG. 2. In this latter case, process of application typically includes ion assist.

Figure 4:
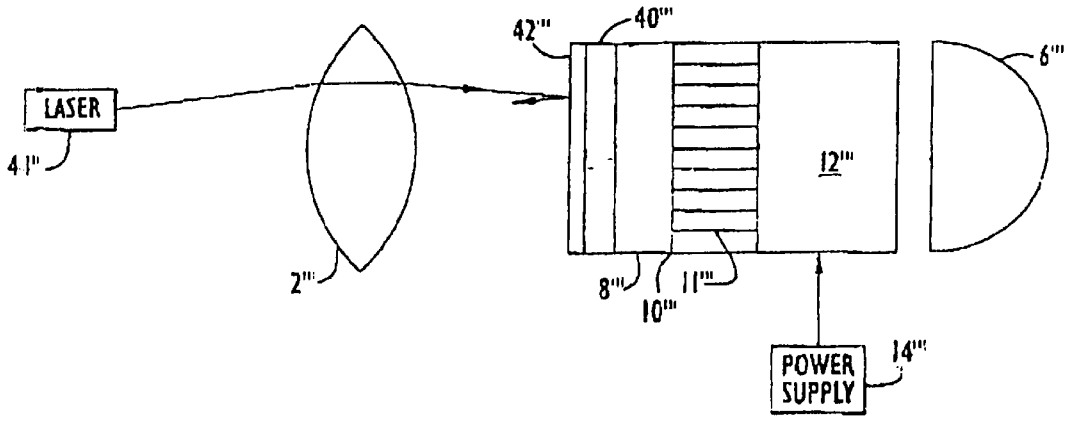
FIG. 4 shows a still further embodiment of the invention.

The operation of a night vision device bearing a laser reflecting coating is depicted in FIG. 4. Coherent radiation from laser 44''' is incident on objective 2''' which focuses it on laser reflecting coating 42''', which substantially reflects the coherent radiation, thus preventing it from damaging the photocathode and microchannel plate. While similar laser reflecting coatings can be implemented in objective lenses, by correcting the problem at the image tube we are able to retrofit fielded and previously manufactured equipment by replacing image tubes. Also, some fielded systems or systems currently in manufacture may already have coatings that are incompatible with laser reflecting coatings.

There thus has been provided an improved night vision device which allows use in the presence of bright lights and/or lasers. The invention finds application in various types of night vision devices, including those for ground troops, aviators and vehicle drivers. It also affords better use of night vision devices in brightly lit urban environments and in the presence of head lights, flash lights and search lights. It is also contemplated by the present invention that existing night vision devices may be retrofitted, for example, by providing them with new image intensifiers which incorporate the invention.

It should be understood that the invention has been described in connection with preferred embodiments and variations which fall within the spirit and scope of the invention will occur to those in the art. Therefore, it is to be understood that the invention to be covered is defined in the claims which are appended hereto.

We claim:

1. A night vision device comprising:

an image intensifier tube for amplifying light;

at least an optical input element disposed on one side of the image intensifier tube;

at least an optical utilization element disposed on the other side of the image intensifier tube;

wherein the image intensifier tube includes a cathode window comprised of an optically transmissive element having a first side which is away from the optical input element and a second side which faces the optical input element, and wherein a photocathode is disposed on the first side of the optically transmissive element and a glass plate bearing an antireflection coating of the interference filter type is adhered to the second side of the optically transmissive element.

2. A night vision device comprising:

an image intensifier tube for amplifying light;

at least an optical input element disposed on one side of the image intensifier tube;

at least an optical utilization element disposed on the other side of the image intensifier tube;

wherein the image intensifier tube includes a cathode window comprised of an optically transmissive element having a first side which is away from the optical input element and a second side which faces the optical input element, and wherein a photocathode is disposed on the first side of the optically transmissive element and a glass plate bearing a laser reflecting coating is adhered to the second side of the optically transmissive element.

* * * * *